US009977379B2

(12) United States Patent
Miyamoto

(10) Patent No.: US 9,977,379 B2
(45) Date of Patent: May 22, 2018

(54) FIXING DEVICE

(71) Applicant: CANON KABUSHIKI KAISHA, Tokyo (JP)

(72) Inventor: Akitomo Miyamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/641,484

(22) Filed: Jul. 5, 2017

(65) Prior Publication Data

US 2018/0017907 A1 Jan. 18, 2018

(30) Foreign Application Priority Data

Jul. 13, 2016 (JP) ..... 2016-138420

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2046; G03G 15/205
See application file for complete search history.

(56) References Cited

U.S. PATENT DOCUMENTS 8,249,480 B2 * 8/2012 Aslam ..... G03G 15/205 399/329
2005/0201768 A1 * 9/2005 Tatematsu ..... G03G 15/205 399/69
2013/0101303 A1 * 4/2013 Kasai ..... G03G 15/205 399/45
2014/0029968 A1 1/2014 Tamaki

FOREIGN PATENT DOCUMENTS

JP 2014-025965 A 2/2014

* cited by examiner

*Primary Examiner* — Gregory H Curran
(74) *Attorney, Agent, or Firm* — Fitzpatrick, Cella, Harper & Scinto

(57) ABSTRACT

A fixing device includes first and second rotatable members, a heating portion, a detecting portion configured to detect a temperature of the first rotatable member, a controller configured to control supplied electrical power to the heating portion depending on the detected temperature, and a setting portion configured to set a nip pressure at a first pressure when a recording material of a first kind is subjected to a fixing process and configured to set the nip pressure at a second pressure less than the first pressure when a recording material of a second kind is subjected to the fixing process. The controller controls the supplied electrical power depending on a difference between a target temperature of the first rotatable member and the detected temperature. The supplied electrical power is less when the nip pressure is the second pressure than when the nip pressure is the first pressure.

6 Claims, 4 Drawing Sheets

FIXING DEVICE

CLAIM OF PRIORITY

This application claims benefit of Japanese Patent Application No. 2016-138420 filed on Jul. 13, 2016, which is hereby incorporated by reference herein its entirety.

FIELD OF THE INVENTION AND RELATED ART

The present invention relates to a fixing device used in a copying machine, a printer, a facsimile machine, a multifunction machine having a plurality of functions of these machines, and the like.

In an image forming apparatus such as the copying machine, a toner image formed on a recording material at an image forming portion is subjected to heat and pressure, and thus, is fixed on the recording material. As an example of this recording material, an envelope is usable. Conventionally, in a case when the toner image is fixed on the envelope, pressure at a nip formed between a fixing roller and a pressing roller is lowered (see, for example, Japanese Laid-Open Patent Application 2014-25965).

This is because, in the case when the envelope is subjected to fixing with the same pressure as that for plain paper, creases generate on the envelope.

Thus, when the pressure at the nip in the fixing device is in a light pressure condition, a heat quantity transmitted from the fixing roller to the pressing roller decreases. For this reason, thermal capacity as the fixing device lowers and electrical power supply to the fixing roller tends to become excessive, so that a temperature ripple of the fixing roller increases. When such a temperature ripple generates, there is a liability that the temperature ripple causes improper fixing.

SUMMARY OF THE INVENTION

According to an aspect, the present invention provides a fixing device comprising first and second rotatable members configured to form a nip therebetween for fixing a toner image formed on a recording material, a heating portion configured to heat the first rotatable member, a detecting portion configured to detect a temperature of the first rotatable member, a controller configured to control supplied electrical power to the heating portion depending on a detected temperature by the detecting portion, and a setting portion configured to set a nip pressure at a first pressure when the recording material of a first kind is subjected to a fixing process and configured to set the nip pressure at a second pressure smaller than the first pressure when the recording material of a second kind is subjected to the fixing process, wherein the controller controls the supplied electrical power depending on a difference between a target temperature of the first rotatable member and the detected temperature, and the supplied electrical power is less when the nip pressure is the second pressure than when the nip pressure is the first pressure.

Further features of the present invention will become apparent from the following description of exemplary embodiments with reference to the attached drawings.

DESCRIPTION OF EMBODIMENTS

Embodiments of the present invention will be specifically described with reference to the drawings.

First Embodiment (Image Forming Apparatus and Fixing Device)

Figure 1:
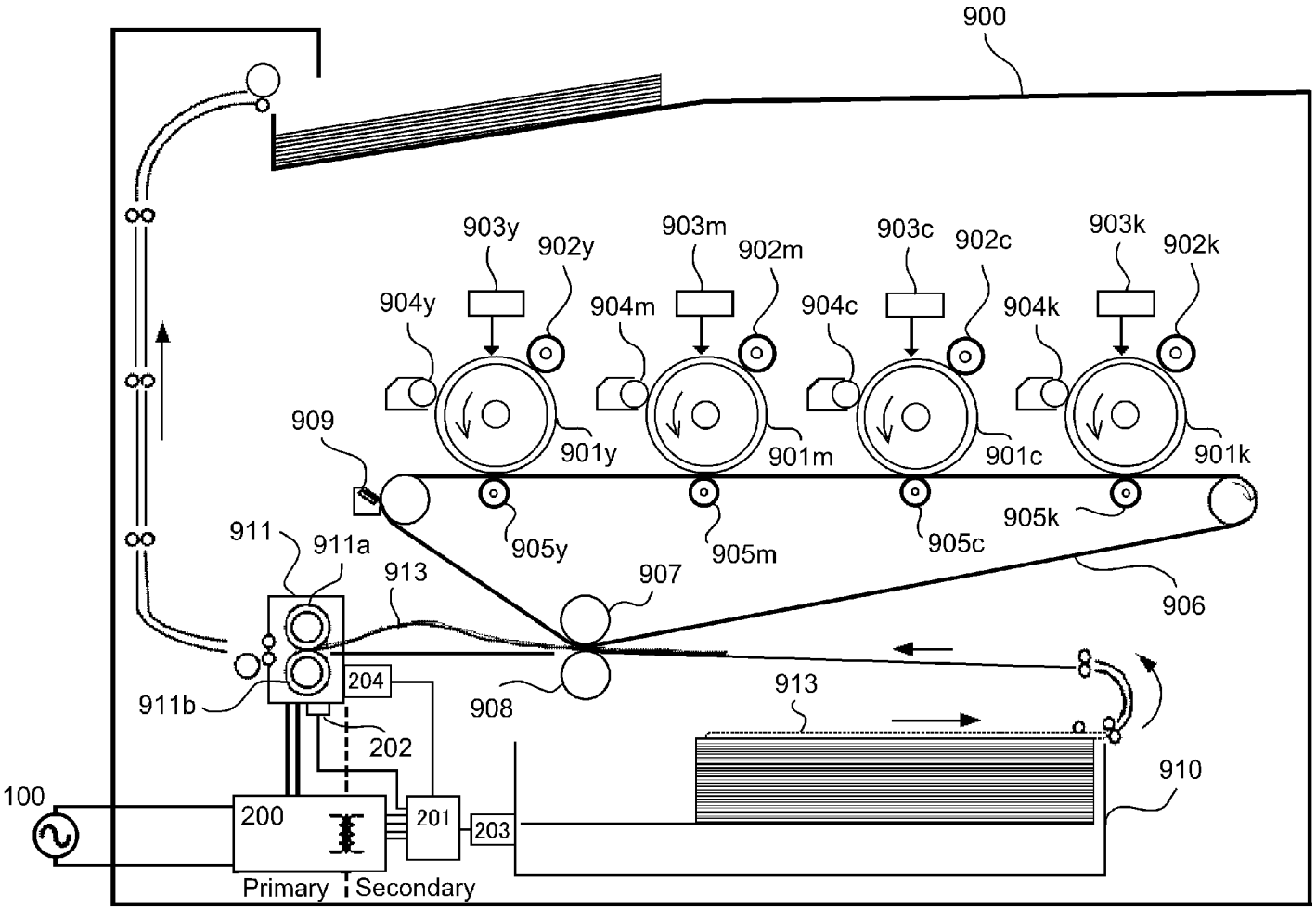
FIG. 1 is a schematic view of an image forming apparatus and a fixing device.

FIG. 1 is a schematic structural view of an image forming apparatus and an image heating apparatus (fixing device) for carrying out an image heating process (fixing process) in an embodiment of the present invention. In the figure, in an image forming apparatus main assembly (printer body) 900, a photosensitive drum 901*y* rotating in a counterclockwise direction is provided, and a surface of the photosensitive drum 901*y* is electrically charged uniformly by a primary charging roller 902*y*. The uniformly charged surface of the photosensitive drum 901*y* is exposed to laser light emitted from a laser unit 903*y*, so that a latent image is formed. Then, the surface of the photosensitive drum 901*y* passes through a developing sleeve 904*y*, so that the latent image on the photosensitive drum 901*y* is developed with yellow toner.

Then, the surface of the photosensitive drum 901*y* contacts an intermediary transfer belt 906. A voltage is applied to a primary transfer roller 905*y*, so that a yellow toner image (image) formed on the surface of the photosensitive drum 901*y* is transferred onto a surface of the intermediary transfer belt 906. Similarly, magenta, cyan, and black toner images (images) are transferred onto the intermediary transfer belt 906.

Thus, on the intermediary transfer belt 906, a full-color image formed with the temperatures of yellow, magenta, cyan, and black is formed. Then, the image on the intermediary transfer belt 906 passes through between an inner secondary transfer roller 907 and an outer secondary transfer roller 908. At that time, a sheet 913 fed from a sheet feeding cassette 910 is nipped and fed between the intermediary transfer belt 906 and the outer secondary transfer roller 908, so that the image on the intermediary transfer belt 906 is transferred onto a surface of the sheet 913.

The sheet 913 on which the toner image is formed passes through between the inner secondary transfer roller 907 and the outer secondary transfer roller 908, and is fed into a fixing device 911 as a fixing device (fixing portion), in which the toner image is fixed on the sheet 913, and then, the sheet 913 is discharged and stacked.

(Electrical Power Supply to Fixing Device and Electrical Power Control in Fixing Device)

The fixing device 911 includes a heating member 911*a* for heating a recording material (sheet 913) and a pressing roller 911*b* as an opposing member, opposing the heating member 911*a*, for forming a nip for nipping and feeding the recording material in cooperation with the heating member 911*a*.

In FIG. 1, a temperature detecting means 202 monitors a fixing temperature of the heating member 911*a* in the fixing device 911. Further, a UI (user interface) 203 sends an input result, of an input of paper kind (kind of the recording material) by a user, to a CPU 201.

In formation on the input result of the paper kind by the UI 203 is sent to a control temperature controlling means 205 and a feeding speed controlling means 206. On the basis of this input result of the paper kind, a target temperature (control temperature) of a fixing belt 404 and a recording material feeding speed (feeding speed of the paper (sheet)) fed by the fixing belt and a pressing belt are set.

The temperature controlling means 205 sends information on the set target temperature (control temperature) of the fixing belt 404 to the CPU 201, so that the control temperature of the fixing belt is controlled.

The feeding speed controlling means 206 sends information on the set recording material feeding speed of the recording material to the CPU 201, so that the recording material feeding speed is controlled.

The fixing device 911 in this embodiment is an induction heating fixing device (IH fixing device) by which the fixing belt is heated by an exciting coil through electromagnetic induction heating, and generates heat by being supplied with electrical power from a power source device 200. Further, the fixing device 911 is constituted by an exciting coil unit 403, a heat generating member (the fixing belt 404 as a heating member) opposing the exciting coil unit 403, the pressing belt 405 as a rotatable pressing member for forming a nip in cooperation with the fixing belt 404, and the temperature detecting means 202 for detecting a temperature of the heating member.

The CPU 201 manages control of an entirety of the image forming apparatus and receives a temperature detection signal of the IH fixing device from the temperature detecting means 202. In addition, the CPU 201 controls the power source device 200 by a driving signal, whereby the CPU 201 supplies desired electrical power to the IH fixing device and carries cut, as an electrical power controller, electrical power control (electrical power supply control) in the IH fixing device.

(Block Diagram)

Figure 2:
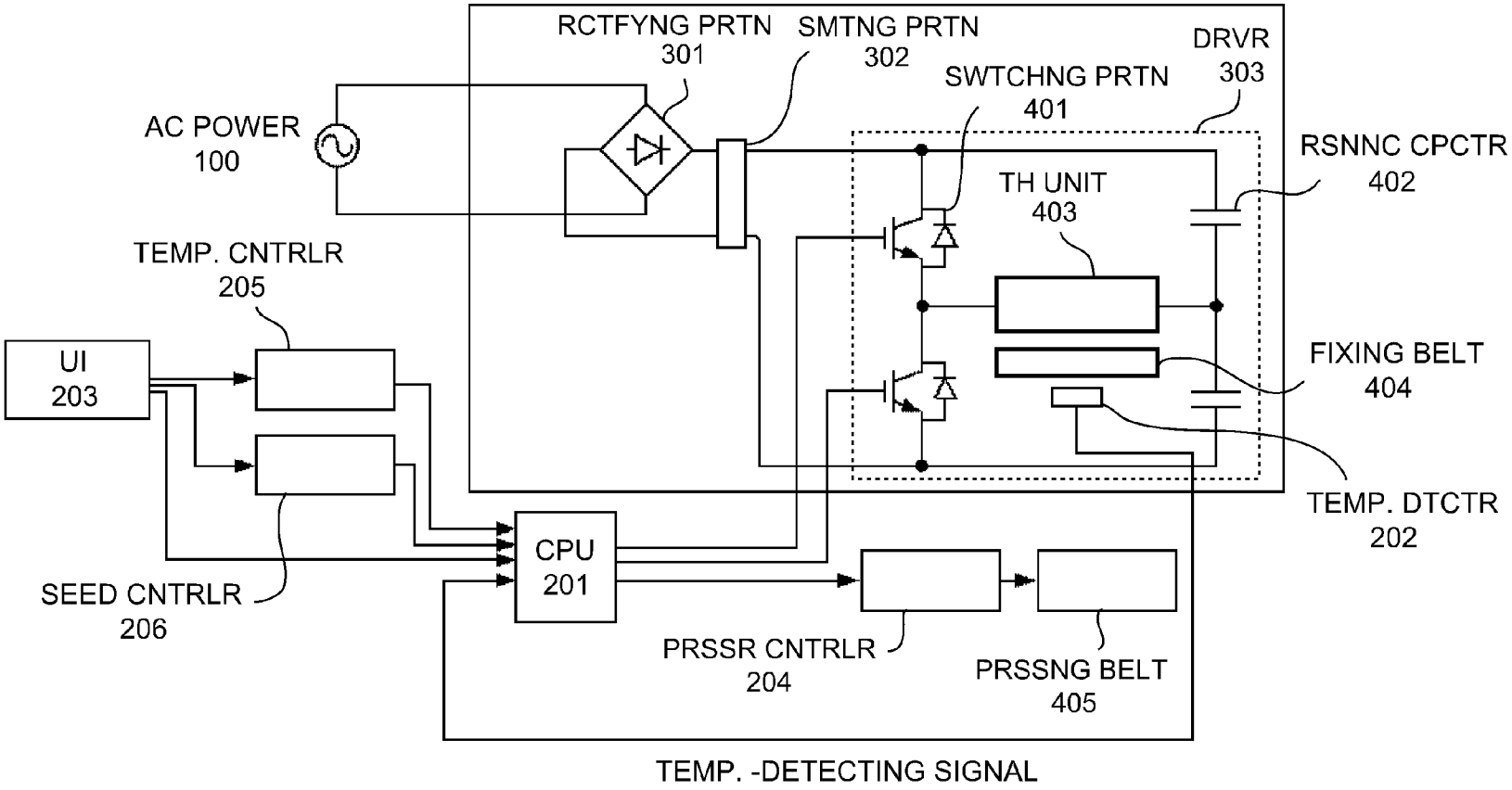
FIG. 2 is a circuit block diagram showing an electric power calculation constitution and a peripheral circuit.

FIG. 2 is a block diagram of the power source device 200 and a peripheral constitution thereof in this embodiment. In FIG. 2, a commercial AC voltage source 100 is provided. The power source device 200 is constituted by a rectifying portion 301, a smoothing portion 302, and a driving portion 303. The driving portion 303 is constituted by a switching portion 401 and a resonance capacitor 402. Further, the IH fixing device is constituted by the IH unit 403, the fixing belt 404, the pressing belt 405 and the temperature detecting means 202, and the CPU 201 receives information from the temperature detecting means 202 and detects a temperature of the IH fixing device.

On the basis of the temperature detection signal of the temperature detecting means 202, the CPU 201 outputs a pulse signal, for controlling ON-OFF of the driving portion 303, to switching portions 401*a* and 401*b* of the driving portion 303 provided in the IH fixing power source device 200. Further, on the basis of the temperature detection signal of the IH fixing device, the CPU 201 carries out control of increasing and decreasing a pulse width of the pulse signal (i.e., control of changing a pulse generation time with the same intensity as described later), so that the CPU 201 adjusts the electrical power supplied to the IH fixing device.

A pressure changing means 204 adjusts, on the basis of information on paper kind setting acquired through the UI 203, pressure (nip pressure) at the nip formed by the fixing belt 404 and the pressing belt 405. When setting of the nip pressure is light pressure setting, the CPU 201 carries out control of lowering an increase/decrease ratio of the pulse width of the pulse signal with respect to a control temperature of the IH fixing device (i.e., control of shortening the pulse generation time at the same intensity so that a change in electrical power decreases, as described later). As a result, excessive electrical power supplied to the IH fixing device in a light pressure state is prevented, so that a temperature ripple of the IH fixing device is prevented.

Further, the control temperature controlling means 205 sends setting information on the control temperature of the fixing belt 404 to the CPU 201 on the basis of information from the UI 203, and the CPU 201 adjusts the electrical power supplied to the IH fixing device so that the control temperature of the fixing belt 404 is the above-described control temperature.

Further, control of the printer 900 is changed in the following manner by the paper kind information acquired through the UI 203.

As shown in Table 1 below, speeds and target temperatures are changed depending on respective paper kind conditions in which the speeds satisfy V1<V2<V3 and the target temperatures satisfy T1<T2<T3<T4. In the case of an envelope, the pressure is set at a light pressure in order to prevent creases.

TABLE 1

| | Speed | TT*1 | Pressure |
|---|---|---|---|
| TNP*2 | V1 | T1 | ACP*6 |
| PP*3 | V1 | T3 | ACP*6 |
| TKP*4 | V2 | T2 | ACP*6 |
| EN*5 | V3 | T4 | LP*7 |

*1"TT" is the target temperature.
*2"TNP" is thin paper.
*3"PP" is plain paper.
*4"TKP" is thick paper.
*5"EN" is the envelope.
*6"ACP" is an all contact pressure.
*7"LP" is a light pressure.

The conditions shown in Table 1 are merely examples, and also under other various setting conditions the printer 900, the speeds, the target temperatures and the pressures may also be similarly set.

Next, control of the power source device 200 by the CPU 201 will be described using a timing chart of FIG. 3 and a flowchart of FIG. 4.

(Timing Chart)

Figure 3:
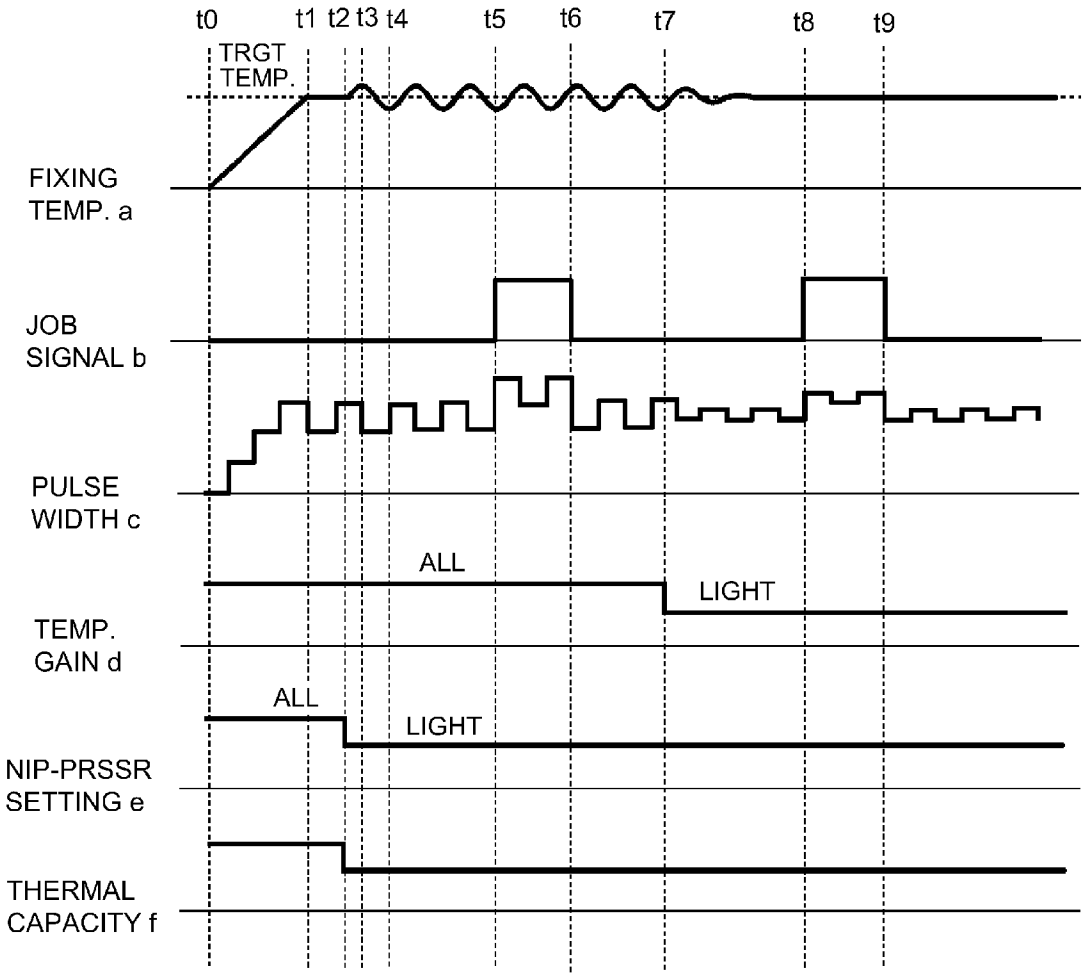
FIG. 3 is a timing chart.

FIG. 3 is the timing chart showing a change in temperature of the fixing device 911 depending on switching of a pulse width ratio of the pulse signal (hereafter referred to as a temperature control gain). An operation from t0 to t5 is performed in conventional control and an operation from t6, and the later is performed in the control in this embodiment.

In FIG. 3, a temperature of the fixing device 911 detected by the temperature detecting means 202 is a fixing temperature a, and a signal for discriminating, by the CPU 201, whether or not the recording material is passed through the fixing device is a JOB signal b. Further, a pulse width of a pulse signal for controlling the switching portion 401 of the driving portion 303 provided in the IH feeding power source device 200 is a pulse width c, and a pulse width increasing/decreasing ratio of the pulse signal is a temperature control gain d. Further, a set value of the pressure at the nip formed in the fixing device 911 is a nip pressure e, and a thermal capacity of the fixing device 911 is a thermal capacity f.

When temperature control of the fixing device 911 is started at time to, nip pressure setting is all contact pressure (setting), in which the thermal capacity is in a large state. At this time, responsiveness of the fixing temperature to the supplied electrical power is slow, and, therefore, setting of the temperature control gain is high setting (all contact setting), and control is carried out so that the temperature of the fixing device reaches the target temperature.

When the fixing device temperature (fixing temperature) reaches the target temperature at the time t1, the CPU 201 carries out temperature control so that the fixing temperature is kept at a constant value. At the time t2, when the sheet kind (paper kind) is changed by the UI 203 and the setting of the nip pressure is changed from the all contact pressure setting to the light pressure setting, the thermal capacity of the fixing device 911 lowers, so that a state, in which electrical power supply to the fixing device 911 is excessive is formed.

Then, at the time t3, a state in which the fixing temperature exceeds the target temperature is formed, and, therefore, the CPU 201 carries out control of narrowing the pulse width (shortening the pulse generation time). However, in the prior art, the temperature control gain is kept at the all contact setting (in a state in which a degree of change in pulse generation time is large), and, therefore, the pulse width is largely narrowed (i.e., a degree of shortening of the pulse generation time is large), so that the fixing temperature is below the target temperature at the time t4.

Thus, when the fixing temperature is below the target temperature, in the prior art, the CPU 201 carries out control of broadening the pulse width (in which a degree of lengthening the pulse generation time is large), so that the fixing temperature exceeded the target temperature again. By this repetition, when the nip pressure is the light pressure (in a low thermal capacity state), as a change in electrical power, an amplitude is large, and, therefore, a problem such that a temperature ripple generates in the fixing temperature existed. This temperature ripple also generated during a job between the time t5 and t6 and caused an image defect.

Therefore, in the control in this embodiment, as at the time t7, control of changing the setting of the temperature control gain to the light pressure setting is carried out by the CPU 201. Specifically, control such that the degree of the change in pulse generation time is small, i.e., that the amplitude (temperature control gain) becomes smaller than that in the case of the electrical power change at the time t3 in the prior art. That is, as regards the pulse width c in FIG. 3, the ordinate represents the pulse generation time and the abscissa represents an elapsed time (operation time), but the change in pulse generation time from the time t7 to the time t8 is made smaller than the change in pulse generation time from the time t4 to the time t5.

Here, the switching portions 401*a* and 401*b* successively operate correspondingly to ON/OFF of the electrical power in the pulse control, so that the change in pulse generation time becomes a first electrical power change in which the amplitude on the basis of a predetermined level (first reference level) is small in a period from the time t7 to the time t8 (FIG. 3). In the prior art, the change in pulse generation time becomes a second electrical power change in which the amplitude on the basis of a predetermined level (second reference level) is large in a period from the time t4 to the time t5 (FIG. 3).

Thus, in this embodiment, in the period from the time t7 to the time t8, in which the setting of the temperature control gain d is changed to the light pressure setting, the change in the pulse generation time (the ordinate of the pulse width c in FIG. 3), i.e., the change in electrical power is suppressed to a small value, so that the temperature ripple of the fixing temperature is suppressed. For this reason, thereafter, even during a job from the time t8 to the time t9, the temperature ripple of the fixing temperature is kept suppressed, so that the image defect is prevented.

As described above, in this embodiment, the setting of the temperature control gain until the fixing temperature reaches the target temperature is a high setting (all contact setting), and in a case when the nip pressure is the light pressure during the temperature control, setting (light pressure setting), in which the temperature control gain is lowered, is employed. As a result, it becomes possible to suppress the temperature ripple during the temperature control while keeping a short reaching time of the fixing temperature to the target temperature.

(Flowchart)

Figure 4:
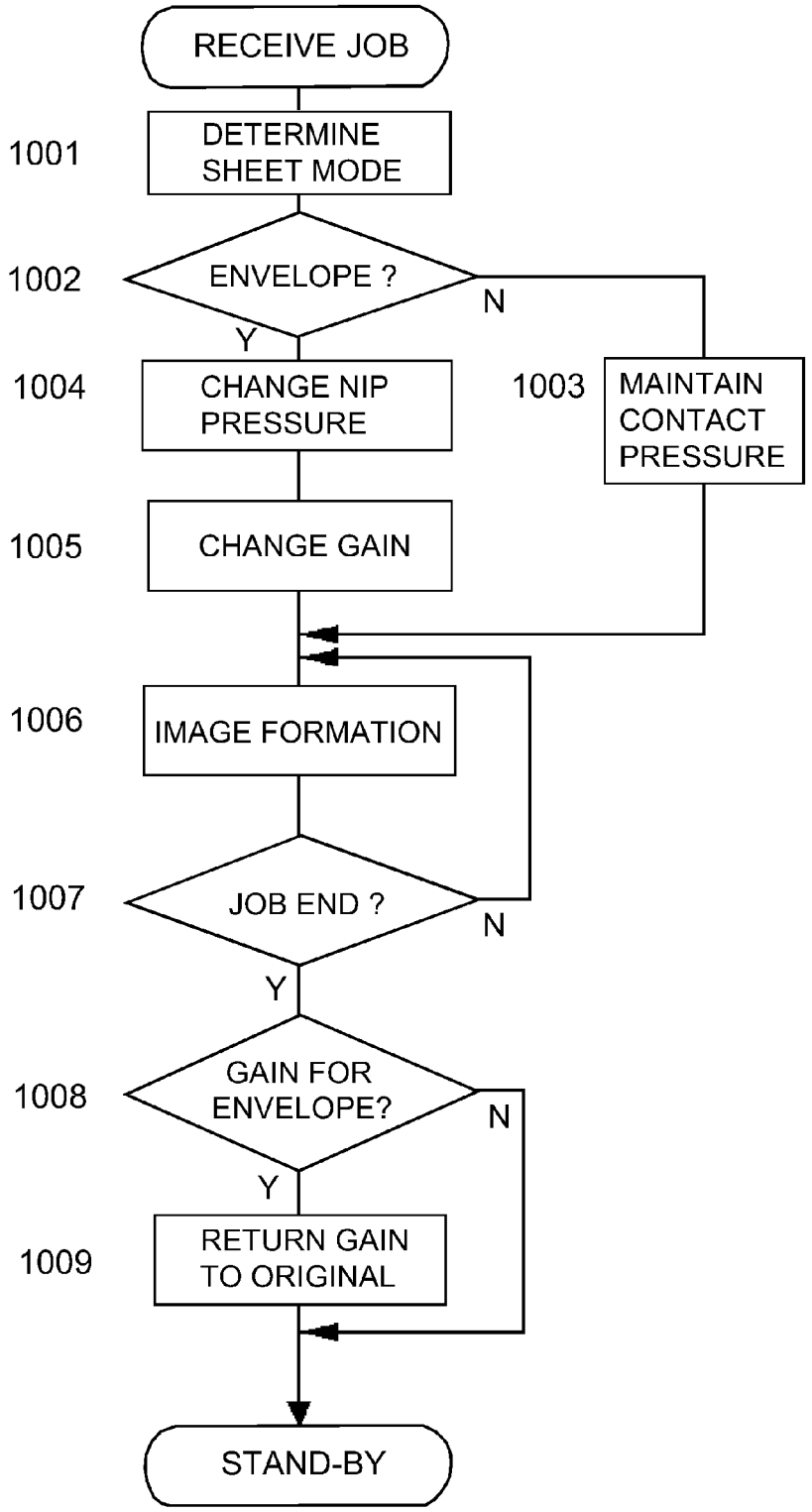
FIG. 4 is a flowchart.

FIG. 4 is a flowchart, in this embodiment, in which the temperature control gain is controlled when the IH fixing device is in a light pressure condition. At the time of a start of the job, the nip pressure of the fixing device is the all contact pressure. The CPU 201 receives information on the paper kind set by the user from the UI 203 and determines a sheet mode during image formation (1001).

The CPU 201 discriminates the set sheet setting (1002), and when the sheet is a material other than an envelope (N of 1002), the CPU 201 keeps the nip pressure setting of the fixing device at the all contact pressure setting (1003) and, then, the sequence goes to sheet passing (1006). When the sheet is an envelope (Y of 1002), the CPU 201 changes the nip pressure setting of the fixing device to an envelope pressure (1004), and changes a set value, of PID control used in the temperature control of the fixing device, to a value for the envelope pressure (1005). Thereafter, the sequence goes to the sheet passing (1006), and in a period until the job is ended, the temperature control is carried out at the same PID control set value (N of 1007).

When the job is ended (Y of 1007), whether or not the temperature control gain is that for the envelope pressure (1008). In a case when the temperature control gain is that for the envelope pressure (Y of 1008), the setting of the temperature control gain is returned to the all contact setting (1009), and, thereafter, the sequence goes to stand-by, and in the case when the temperature control gain is not that for the envelope pressure (N of 1008), the sequence directly goes to stand-by. Thereafter, the same control is effected every start of the job.

In the description above, the target temperature (control temperature) of the fixing belt is the same between the case of the all contact setting and the case of the light pressure setting. However, in the present invention, in order to obtain a crease preventing effect of the recording material (envelope), in the case of the light pressure setting (in which the sheet setting is the envelope), compared with the case of the all contact setting, control of reducing the supplied electric power may preferably be carried out by lowering the target temperature (e.g., by 10° C.)

Further, between the case of the all contact setting and the case of the light pressure setting, the recording material feeding speed by the fixing device may also be made the same, and in the case of the light pressure setting (in which the sheet setting is the envelope), compared with the case of the all contact setting, the recording material feeding speed by the fixing device may also be made slow. In order to obtain the crease preventing effect of the recording material (envelope), it is advantageous that the recording material feeding speed by the fixing device is made fast, and, therefore, in the case of the light pressure setting, the recording material feeding speed may preferably be the same as that in the case of the all contact setting. In the case when the fixing property becomes disadvantage due to the crease preventing effect of the recording material (envelope), it is possible to appropriately combine the target temperature with the recording material feeding speed.

Effect of this Embodiment

As described above, according to this embodiment, when the nip pressure is in the light pressure state during the print job, by reducing an increasing/decreasing amount (temperature control gain) of the pulse signal used in the temperature control of the fixing belt, a ripple of electrical power supplied to the fixing belt during the printing can be suppressed. As a result, while keeping a rise time of warm up unchanged, the temperature ripple generating on the fixing belt during the printing is reduced, so that it becomes possible to prevent improper fixing.

MODIFIED EMBODIMENTS

In the above, the preferred embodiment of the present invention was described, but the present invention is not limited thereto, and can be variously modified and changed within the scope of the present invention.

Modified Embodiment 1

In the above-described embodiment, as an example of the light pressure fixing device, the IH fixing device was described, but the control may also be carried out similarly in other light pressure fixing devices using heat sources such as a halogen heater and a ceramic heater. In this case, with respect to a difference between the target temperature and the detection temperature (detected temperature) of the fixing device, by changing a phase angle at which an element such as a triac for performing AC conduction to the fixing device is subjected to ON-OFF control, phase control for adjusting the supplied electrical power may preferably be used. This phase angle control is changed between the all contact pressure (setting) and the light pressure (setting), so that an effect similar to that of the above-described embodiment can be obtained.

Modified Embodiment 2

In the above-described embodiment, the nip pressure setting was described as two types consisting of the all contact pressure setting and the light pressure setting, but a constitution in which an individual nip pressure is set depending on the paper kind and a temperature control gain corresponding to the set nip pressure is individually provided may also be employed. Further, in the above-described embodiment, the paper kind as a condition of the nip pressure setting is set by the operation of the UI, but the kind of the recording material may also be discriminated by a paper kind detecting means as a discriminating means for detecting and discriminating a size of the recording material.

Modified Embodiment 3

In the above-described embodiment, as an acquiring means for acquiring a heating state information of the heating member, the thermistor as the temperature detecting means for detecting the temperature of the heating member was used, but a means (warming index) for predicting a warming-up state (degree of warming-up) of the heating member in the fixing device may also be used.

Modified Embodiment 4

In the above-described embodiment, the control of modulating the pulse width (decreasing the degree of the change in pulse width at the light pressure setting) was described, but control of changing a pulse number (decreasing a degree of a change in pulse number at the light pressure setting) can also be used.

Modified Embodiment 5

In the above-described embodiment, a case when the rotatable fixing member (fixing belt) is pressed by the rotatable pressing member as the pressing member was described. However, the present invention is not limited thereto, and is similarly, applicable also to a case when a rotatable member as an opposing member, not the pressing member is pressed by the rotatable fixing member.

Modified Embodiment 6

In the above-described embodiment, as the recording material, the recording paper was described, but the recording material in the present invention is not limited to recording paper. In general, the recording material is a sheet-like member on which the toner image is to be formed by the image forming apparatus and includes, for example, regular and irregular sheet-like members, such as plain paper, thick paper, thin paper, an envelope, a postcard, a seal, a resin sheet, an OHP sheet, glossy paper, and the like. In this embodiment, for convenience, the term "paper" such as the paper kind was used for the recording material (sheet) P was used for description, but the recording material in the present invention is not limited to the paper.

Modified Embodiment 7

In the above-described embodiment, the fixing device for fixing the unfixed toner image was described as an example, but the present invention is not limited thereto. The present invention is also similarly applicable to a device for heating and pressing the toner image that has been temporarily fixed on the sheet (in this case, the device is also referred to as a fixing device).

Modified Embodiment 8

In the above-described embodiment, the change in control temperature by the control temperature controlling means 205 was carried out by the operation (input of the setting of the paper kind) of the UI by the user, but the present invention is not limited thereto. The change in control temperature may also be carried out on the basis of the paper kind detected by a paper kind detecting means (optical sensor, ultrasonic sensor) provided in a paper (sheet) feeding path.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device comprising:

a first rotatable member and a second rotatable member configured to form a nip therebetween for fixing a toner image formed on a recording material;

a heating portion configured to heat said first rotatable member;

a detecting portion configured to detect a temperature of said first rotatable member;

a controller configured to control supplied electrical power to said heating portion depending on a detected temperature by said detecting portion; and a setting portion configured to set a nip pressure at a first pressure when the recording material of a first kind is subjected to a fixing process and configured to set the nip pressure at a second pressure less than the first pressure when the recording material of a second kind is subjected to the fixing process, wherein said controller controls the supplied electrical power depending on a difference between a target temperature of said first rotatable member and the detected temperature, the supplied electrical power being less when the nip pressure is the second pressure than when the nip pressure is the first pressure.

2. A fixing device according to claim 1, wherein the target temperature of said first rotatable member is capable of changed depending on the kind of the recording material.

3. A fixing device according to claim 1, wherein the recording material of the second kind is an envelope.

4. A fixing device comprising:

a first rotatable member and a second rotatable member configured to form a nip therebetween for fixing a toner image formed on a recording material;

a heating portion configured to heat said first rotatable member;

a detecting portion configured to detect a temperature of said first rotatable member;

a controller configured to control supplied electrical power to said heating portion depending on a detected temperature by said detecting portion so that the temperature of said first rotatable member is a target temperature depending on a kind of the recording material; and a setting portion configured to set a nip pressure at a first pressure when the recording material of a first kind is subjected to a fixing process and configured to set the nip pressure at a second pressure less than the first pressure when the recording material of a second kind is subjected to the fixing process, wherein said controller controls the supplied electrical power depending on a difference between the target temperature and the detected temperature, the supplied electrical power being less when the nip pressure is the second pressure than when the nip pressure is the first pressure.

5. A fixing device according to claim 4, wherein the target temperature corresponding to the recording material of the first kind is different from the target temperature corresponding to the recording material of the second kind.

6. A fixing device according to claim 4, wherein the recording material of the second kind is an envelope.

* * * * *